US005754150A

United States Patent [19]

Matsui

[11] Patent Number: 5,754,150

[45] Date of Patent: May 19, 1998

[54] LIQUID CRYSTAL LUMINANCE ADJUSTING APPARATUS

[75] Inventor: Takao Matsui, Kashihara, Japan

[73] Assignee: Sharp Kabushiki Kaisha, Osaka, Japan

[21] Appl. No.: 550,802

[22] Filed: Oct. 31, 1995

[30] Foreign Application Priority Data

Feb. 17, 1995 [JP] Japan ..... 7-029478

[51] Int. Cl.[6] ..... G09G 3/36

[52] U.S. Cl. ..... 345/89; 345/207

[58] Field of Search ..... 345/89, 147, 207

[56] References Cited

FOREIGN PATENT DOCUMENTS 4-351071 12/1992 Japan .
5-94156 4/1993 Japan .

*Primary Examiner*—Richard Hjerpe

*Assistant Examiner*—Ronald Laneau

[57] ABSTRACT

To provide a luminance adjusting apparatus making it possible to narrow the output dynamic range of a picture signal processing section and decreasing the cost of a horizontal driver. The following are arranged: a variable gamma correction circuit (12) for synchronously changing an inflection point of a gamma correction curve and a common voltage generated by a common voltage control circuit (7) by the fact that a luminance adjusting dial is adjusted, a timing signal processing circuit (3) for generating a timing pulse, a picture signal processing circuit (5) for processing a picture signal, a horizontal driver, a common voltage generation circuit (7) for generating a common voltage, a vertical driver (8), and a common driver (9). A picture signal is inputted to the variable gamma correction circuit (12) from a signal source and the inflection point of the gamma correction curve and the common voltage generated by the common voltage control circuit (7) are synchronously changed by manually adjusting the luminance adjusting dial.

11 Claims, 13 Drawing Sheets

LIQUID CRYSTAL LUMINANCE ADJUSTING APPARATUS

BACKGROUND OF THE INVENTION

1. Field of the Invention

The present invention relates to a luminance adjusting apparatus, particularly to a luminance adjusting apparatus used for a picture signal processor of a liquid crystal display (e.g. TFT-type liquid crystal display).

2. Description of the Related Arts

A luminance adjusting apparatus has been known so far which is used for a picture signal processor of a liquid crystal display.

FIG. 8 shows the input voltage luminance characteristic of a liquid crystal panel. Because FIG. 8 shows a normally-white liquid crystal panel, the following description is also made in accordance with the normally-white liquid crystal panel. However, the same is applied to a normally-black liquid crystal panel. In the case of the normally-white liquid crystal panel, the luminance lowers when the input voltage of the panel is higher than the potential of a common electrode of the panel but the luminance rises when the input voltage is lower than the potential of it. Moreover, nonlinearity of the input voltage is shown at a portion where the input voltage is low and a portion where the input voltage is high. In general, a picture-signal voltage is corrected in accordance with the characteristic of a cathode-ray tube. Therefore, in the case of a liquid crystal display, it is necessary to convert an input picture-signal voltage into a picture signal voltage adapted to a liquid crystal panel by a gamma correction circuit as shown by the input/output voltage characteristic curve in FIG. 9.

The gamma correction circuit of a conventional liquid crystal display is a circuit having a characteristic in which amplification factors are changed due to a picture-signal input voltage and the characteristic is approximated to the input/output voltage characteristic in FIG. 9. A conventional gamma correction circuit having a ternary amplification factor has the input/output voltage characteristic shown in FIG. 10.

The input/output voltage characteristic in FIG. 10 is described below.

It is assumed that the output voltage of a gamma correction circuit when a liquid crystal panel has a minimum luminance (black display) as Y0 and the output voltage of the circuit when the panel has a maximum luminance (100% white display) as Y1. In this case, the input voltage of the gamma correction circuit shows V0 when the output voltage of the gamma correction circuit equals Y0 and V1 when the output voltage equals Y1. In the case of a gamma correction circuit having the input/output voltage characteristic in FIG. 10, the characteristic is approximated to the gamma characteristic curve in FIG. 9 at amplification factors A1, A2, and A3 at the both sides of input voltages V3 and V4 respectively.

In the case of a picture-signal processing circuit having the above gamma correction characteristic, the luminance adjustment shown in FIG. 11 is conventionally performed. That is, a luminance is set in accordance with a position on a corresponding gamma correction curve at which a black level of an input signal is set. In the case of an input waveform a in FIG. 11, a black level of an input signal is set so that it also becomes black for the display on a liquid crystal panel and white 100% of the input signal is set so that it also becomes white 100% for the display on the liquid crystal panel. In this case, it is assumed that the input signal voltage for displaying gray (white 50%) is V1 and the output of a gamma correction circuit to V1 is Y1.

When changing the input waveform from a to c, an input signal for showing a black level slightly brighter than black is displayed as black on a liquid crystal panel and an input signal for white 100% displays white with a less luminance than 100% white. In this case, the input signal voltage for showing gray (white 50%) is already changed from V1 to V1' and the output voltage of the gamma correction circuit is also changed from Y1 to Y1'.

A luminance displayed on a liquid crystal panel is determined by a difference voltage between a common electrode voltage and an input signal voltage of liquid crystal. Therefore, the luminance lowers as the difference voltage rises. Thus, when changing an input waveform from a to c and noticing the output voltages Y1 and Y1' of the gamma correction circuit corresponding to the input voltages V1 and V1' for showing gray (white 50%), Y1' is displayed more darkly than Y1 because the potential difference of Y1 to the common electrode is higher than that of Y1' to the common electrode. Therefore, it is found that the input waveform c is displayed more darkly than the input waveform a as a whole.

Moreover, when changing the input waveform from a to b, the black level of the input signal is displayed as black color brighter than black on the liquid crystal panel, the input signal voltage for showing gray shows white 100%, and the input waveform b is displayed more brightly than the input waveform a as a whole. Output waveforms of the gamma correction circuit corresponding to the input waveforms a, b, and c respectively are shown as A, B, and C respectively.

In the case of the above luminance adjusting apparatus, an output dynamic range necessary for the gamma correction circuit requires a range equal to or wider than the range from black to white 100% as shown by an output waveform of the gamma correction circuit. This is because the characteristic of liquid crystal input voltage and luminance shown in FIG. 8 is a luminance characteristic when viewing a liquid crystal panel from a predetermined direction and the characteristic shifts in the input voltage direction by changing the angles for viewing the liquid crystal panel. Therefore, when the output waveform of the gamma correction circuit in FIG. 11 changes from A to B, it is necessary to previously input a waveform having gradations even for white 100% or more of the waveform A to the liquid crystal panel. Also when an exit waveform changes from A to C, it is necessary to previously input a waveform having gradations up to a voltage lower than the output voltage of the gamma correction circuit showing black at the waveform A to the liquid crystal panel. Therefore, a conventional luminance adjusting apparatus requires a wide output dynamic range of a gamma correction circuit, that is, a wide dynamic range of a picture-signal processing circuit.

As shown in FIG. 12, a peripheral circuit for driving a liquid crystal panel 10 comprises a level shift circuit 2 for adjusting the luminance of a picture signal sent from a signal source 1 and a timing signal processing circuit 3 for generating a timing pulse. The level shift circuit 2 and the timing signal processing circuit 3 connect with a gamma correction circuit 4 for applying gamma correction to an input picture signal in accordance with the characteristic of a liquid crystal panel. Moreover, the gamma correction circuit 4 and the timing signal processing circuit 3 connect with a picture signal processing circuit 5 for applying a predetermined processing to a picture signal, and the picture signal processing circuit 5 and the timing signal processing circuit 3 connect with a horizontal driver 6. The timing signal processing circuit 3 connects with a common voltage generation circuit 7 for generating a common voltage and a vertical driver 8. The common voltage generation circuit 7 connects with a common driver 9.

A picture signal from the signal source 1 is inputted to the picture signal processing section 5 through the level shift circuit 2 and the above-mentioned gamma correction circuit 4. Moreover, the picture signal is inputted to the timing signal processing section 3.

The level shift circuit 2 and the gamma correction circuit 4 apply gamma correction and luminance adjustment according to the characteristic of a liquid crystal panel to an input picture signal, moreover generate a positive-polarity picture signal with the same polarity as the corrected signal and a negative-polarity picture signal with the opposite polarity to the corrected signal, and apply the signals to the liquid crystal panel 10 through the horizontal driver 6. Moreover, the polarity of a common electrode voltage of the liquid crystal panel 10 is inverted correspondingly to the signal polarity inversion and the voltage with an inverted polarity is applied to the liquid crystal panel 10 through the common driver 9. The timing signal processing section 3 extracts a sync signal from a picture signal, generates a timing pulse synchronous with the sync signal, and supplies the pulse to the horizontal driver 6, vertical driver 8, and each signal processing section to synchronize the whole operation of the system.

A conventional gamma correction circuit is described below by referring to FIGS. 13 and 14.

An amplifier α comprises transistors Q1 and Q2, a variable power source Y1, constant current sources I1 and I2, and resistances R1 and R2. The amplifier a also serves as a level shift circuit for changing DC voltages of an output voltage VOUT1. The output stage of the amplifier α connects with a compression circuit β comprising transistors Q3 and Q4, a constant voltage source V2, and a constant current source I3. Moreover, the output stage of the amplifier a connects with a compression limit circuit γ comprising transistors Q6 and Q7, a constant current source I5, and a resistance R4.

Operations of the gamma correction circuit are described below. For the description, base current of a transistor is ignored and it is assumed that a base-emitter voltage is VBE (constant) for an NPN or PNP transistor, a current flowing through R2 is I6, a current flowing through R3 is I7, a collector current of the transistor Q2 is I8, and a current flowing through R1 is I9.

First, base potential V3 of Q5 is obtained as shown below.

$$V3=\text{VOUT1}-\text{VBE}(Q7)-R4\times I5+\text{VBE}(Q6)=\text{VOUT1}-R4\times I5$$

When noticing Q4 and Q5, emitters of Q4 and Q5 have a common potential. Therefore, when comparing the base potential V2 of Q4 with the base potential V3 of Q5, the emitter voltage of Q4 comes to V2–VBE(Q4) in the case of V2>V3 because the constant current I3 flows through Q4. Similarly, in the case of V2<V3, the emitter potential of Q5 comes to V3–VBE(Q5) because the constant current I3 flows through Q5.

(1) Operation in the case of V2>V3

Namely, this is a case of V2>VOUT1–R4×I5 or a case of VOUT1<V2+R4×I5 which is a transformation of the above inequality.

When noticing R3 and Q3, no current flows through Q3 or R3 (I7=0) unless VOUT1 is equal to or larger than V2–VBE(Q4)+VBE(Q3)=V2 because the base potential of Q3 (emitter potential of Q4) equals V2–VBE(Q4) as described above. When VOUT1 is equal to or larger than V2, a current of I7=(VOUT1–V2)/R3 flows. Therefore, the following two cases are separately described below: (a) VOUT1<V2 and (b) VOUT1>V2.

(a) In the case of VOUT1<V2, the following equations are effected.

I7=0

I6=18+I7

I8+I9=I2

I9=(ϵ–V1)/R1

VOUT1=VCC–R2×I6

In this case, it is assumed that the source voltage is VCC and the black level of a picture signal inputted to Q1 is ϵ.

By solving the above simultaneous equation, the following expression is obtained.

$$\text{VOUT1}=\text{VCC}-R2\times I2+R2/R1\times(\epsilon-\text{V1})$$

That is, it is found that the output voltage VOUT1 changes for the input voltage ϵ–V1 at a gain of R2/R1.

(b) In the case of VOUT1>V2, the following equations are effected.

I7=(VOUT1–V2)/R3

I6=18+I7

I8+19=I2

I9=(ϵ–V1)/R1

VOUT1=VCC–R2×I6

By solving the above simultaneous equation, the following expression is obtained.

$$VOUT1 = \frac{R3}{R3+R2} \times \left( VCC - R2 \times I2 + \frac{R2}{R3} \times V2 \right) + \frac{R3}{R3+R2} \times \frac{R2}{R1} \times (\epsilon - V1)$$

That is, the output voltage VOUT1 changes for the input voltage ϵ–V1 at a gain of R3/(R3+R2)×R2/R1, the gain decreases to R3/(R3+R2) times for the input voltage gain R2/R1, and the output is compressed.

(2) Operation in the case of V2<V3

Namely, this is a case of V2<VOUT1–R4×I5 or a case of VOUT1>V2+R4×I5 which is a transformation of the above inequality. In this case, the following equations are effected.

I7=(VOUT1–V3)/R3

I6=I8+I7

I8+I9=I2

I9=(ϵ–V1)/R1

VOUT1=VCC–R2×I6

V3=VOUT1–R4×I5

By solving the above simultaneous equation, the following expression is obtained.

$$VOUT1 = VCC - R2 \times I2 - \frac{R2}{R3} \times R4 \times I5 + \frac{R2}{R1} \times (\epsilon - V1)$$

That is, the limited gain in the above Item (1) (b) recovers to R2/R1 and compression of the output amplitude is limited.

FIG. 14 is a diagram showing the above calculation results by assigning ϵ–V1 to x axis and VOUT1 to y axis. By setting V1=ϵ, the input state, shown by (a) in FIG. 11 is set and the output waveform shown by (A) in FIG. 11 is obtained. Moreover, by setting V1=ϵ+R1/R2(V2−VCC+R2×I2), the input state shown by (c) in FIG. 11 is set and the output (C) is obtained.

Furthermore, by setting V1=ϵ−R1/R2(V2−VCC+R2×I2), (b) and (B) in FIG. 11 are obtained.

As a conventional luminance adjusting apparatus, there is a liquid crystal display which is disclosed in the official gazette of Japanese Patent Application Laying-Open No. 5-94156/1993. The liquid crystal display lowers the luminance by lowering the contrast. Moreover, to prevent a gradation display from deteriorating due to lowering of the contrast, the liquid crystal display changes a gamma correction curve so that a complete gradation display can be obtained.

In the case of the conventional system shown in FIG. 12 described above, when the picture signal processing section has a wide output voltage range, that is, a wide output dynamic range, it is necessary to raise the withstand voltage of a horizontal driver IC. To raise the withstand voltage, it is necessary to add a process for raising the withstand voltage to an IC fabrication process or increase intervals between devices. Thereby, the chip size of the horizontal drive IC increases. Moreover, by increasing the chip size, the cost of the horizontal driver 6 increases and thereby, the whole cost of the liquid crystal module 11 including the horizontal driver 6, vertical driver 8, common driver 9, and liquid crystal panel 10 is increased.

Moreover, in the case of the conventional liquid crystal display disclosed in the official gazette of Japanese Patent Application Laying-Open No. 5-94156/1993, the luminance around the black side hardly changes even if the white-side luminance changes. When viewing a liquid crystal panel at night by adjusting the luminance of the panel to the optimum value in the daytime, the pupil of a person opens at night compared to the pupil in the daytime and the person's eye becomes sensitive to gradations of the black side but it becomes insensitive to gradations of the white side. Therefore, it is necessary to lower the luminance of the white side and that of the black side at the same time. This is because the luminance judged to be black in the daytime is seen as a luminance brighter than black when the pupil opens at night. However, when viewing the panel in the daytime by adjusting the luminance to the optimum value at night, the person's pupil closes compared to the pupil in the nighttime, the person's eye becomes insensitive to gradations of the black side and sensitive to gradations of the white side. Therefore, it is necessary to raise the luminance of the white side and that of the black side at the same time. The pupil closed in the daytime cannot judge the gradations of the black side unless the luminance of the black side is raised. Therefore, luminance adjustment of the black side is not considered for changes of the peripheral condition of the liquid crystal panel.

Moreover, because the luminance characteristics of liquid crystal change even in the daytime depending on an angle for viewing a liquid crystal panel, liquid crystal may be seen to be gray brighter than black when viewing the liquid crystal from a diagonal direction even if the liquid crystal is seen to be black when viewing it from the front of it. Therefore, it is necessary to move a black level. However, because a luminance change of the black side is not considered, gradations can be shown only when viewing the liquid crystal from the front of it.

The present invention is made to solve the above problems and its object is to provide a luminance adjusting apparatus making it possible to narrow down the output dynamic range of a picture signal processing section and decrease the cost of a horizontal driver.

SUMMARY OF THE INVENTION

According to the present invention, the above objects are achieved by the luminance adjusting apparatus for liquid crystal displays such as TFT-type liquid crystal display, comprising correction means for correcting the output voltage of a picture signal by changing three or more inflection points of a gamma correction curve, voltage control means for controlling common electrode voltage and adjustment means for adjusting said control contol means by synchronizing with the correction means.

According to the present invention, the above objects are achieved by the luminance adjusting apparatus, wherein the adjustment means is manually adjustable.

According to the present invention, the above objects are achieved by the luminance adjusting apparatus, wherein the adjustment means detects a light intensity around the luminance adjusting apparatus and synchronously changes the correction means and the voltage control means in accordance with the detected light intensity.

According to the present invention, the above objects are achieved by the luminance adjusting apparatus, wherein the adjustment means detects a tilt of the screen of the luminance adjusting apparatus and synchronously changes the correction means and the voltage control means in accordance with the detected tilt.

According to the present invention, the above objects are achieved by the luminance adjusting apparatus, wherein the luminance adjusting apparatus further comprises a pedestal clamp circuit for clamping a pedestal level of an output signal at a first predetermined voltage.

According to the present invention, the above objects are achieved by the luminance adjusting apparatus, wherein the adjustment means changes a common electrode voltage so that the voltage becomes equal to the sum of the voltage of one of the inflection points and a second predetermined voltage.

According to the present invention, the above objects are achieved by the luminance adjusting apparatus, wherein the apparatus for adjusting the luminance of a liquid crystal display further comprises means for setting a first reference voltage, a second reference voltage higher than the first reference voltage, and a third reference voltage higher than the second reference voltage as inflection points of a gamma correction curve; means for compressing the output voltage at a first compression ratio when it is lower than the first reference voltage, means for compressing the output voltage at a second compression ratio when it is higher than the second reference voltage, means for compressing the output voltage at the second compression ratio when it is higher than the third reference voltage, correction means for correcting the output voltage of a picture signal by synchronously changing the first and second reference voltages, and adjustment means for changing a common electrode voltage by synchronizing with the correction means.

According to the present invention, the above objects are achieved by the luminance adjusting apparatus, wherein the luminance adjusting apparatus further comprises a pedestal clamp circuit for clamping a pedestal level of an output signal at a first predetermined level.

According to the present invention, the above objects are achieved by the luminance adjusting apparatus, wherein the luminance adjusting apparatus further comprises means for changing the second reference voltages.

According to the present invention, the above objects are achieved by the luminance adjusting apparatus, wherein the correction means for synchronously changing the first and second reference voltages so that the difference between the first reference voltage and the second reference voltage becomes equal to or larger than the difference between the second reference voltage and the third reference voltage.

According to the present invention, the above objects are achieved by the luminance adjusting apparatus, wherein the adjustment means changes a common electrode voltage so that the voltage becomes equal to the sum of the second reference voltage and a second predetermined voltage.

In the case of the luminance adjusting apparatus of the present invention, three or more inflection points of a gamma correction curve are changed by correction means and inflection points of the correction curve of the output voltage of a picture signal and a common electrode voltage are synchronously changed by adjustment means, and thereby luminance adjustment is performed. Therefore, it is possible to perform luminance adjustment in a narrow dynamic range and decrease the cost of the luminance adjusting apparatus.

In the case of the luminance adjusting apparatus of the present invention, inflection points of a gamma correction curve and common electrode voltage are optionally changed because adjustment means is variable. Thereby, it is possible to perform luminance adjustment corresponding to the operational situation.

In the case of the luminance adjusting apparatus of the present invention, external light is detected by adjustment means, inflection points of a gamma correction curve and common electrode voltage are synchronously changed in accordance with the detection result, and thereby luminance adjustment is performed. Therefore, it is possible to automatically perform luminance adjustment correspondingly to changes of the peripheral condition used.

In the case of the luminance adjusting apparatus of the present invention, a tilt of a liquid crystal display is detected by adjustment means and inflection points of a gamma correction curve and a common electrode voltage are synchronously changed in accordance with the detection result, and thereby luminance adjustment is performed. Therefore, it is possible to automatically perform luminance adjustment correspondingly to changes of the tilt of the liquid crystal display.

In the case of the luminance adjusting apparatus of the present invention, a pedestal level of an output signal adjusted by a pedestal clamp circuit is clamped at a first predetermined voltage. Therefore, it is possible to keep a black level constant even if the average value of an input signal changes.

In the case of the luminance adjusting apparatus of the present invention, a common electrode voltage is changed so as to be equal to the sum of the voltage of one inflection point and a second predetermined voltage. Therefore, it is possible to perform luminance adjustment in a constant dynamic range.

In the case of the luminance adjusting apparatus of the present invention, a gamma correction curve using first, second, and third reference voltages as inflection points is set by means for setting a reference voltage, means for performing compression at first and second compression ratios, and means for limiting the second compression ratio. The output voltage of the picture signal is corrected by the correction means according to the correction curve and the common electrode voltage is changed by the adjustment means by synchronously changing the first and second reference voltages. Therefore, it is possible to perform luminance adjustment in a narrow dynamic range and decrease the cost of the luminance adjusting apparatus.

In the case of the luminance adjusting apparatus of the present invention, a pedestal level of an output signal adjusted by a pedestal clamp circuit is clamped at a first predetermined voltage. Therefore, it is possible to keep a black level constant even if the average value of an input signal changes.

In the case of the luminance adjusting apparatus of the present invention, inflection points of a gamma correction curve are optionally changed by means for changing a second reference voltage. Therefore, it is possible to perform luminance adjustment corresponding to the operational situation.

In the case of the luminance adjusting apparatus of the present invention, first and second reference voltages are synchronously changed so that the difference between first and second reference voltages becomes equal to or larger than the difference between second and third reference voltages. Therefore, it is possible to correct an output voltage without changing a gamma correction curve.

In the case of the luminance adjusting apparatus of the present invention, a common electrode voltage is changed by adjustment means so that the voltage becomes equal to the sum of a second reference voltage and a second predetermined voltage. Therefore, it is possible to perform luminance adjustment in a constant dynamic range.

Further objects and advantages of the present invention will be apparent from the following description of the preferred embodiments of the present invention as illustrated in the accompanying drawings.

DESCRIPTION OF THE PREFERRED EMBODIMENTS

The first embodiment (luminance adjusting apparatus for driving a TFT-type liquid crystal display) of the luminance adjusting apparatus of the present invention is described below by referring to the accompanying drawings.

Figure 1:
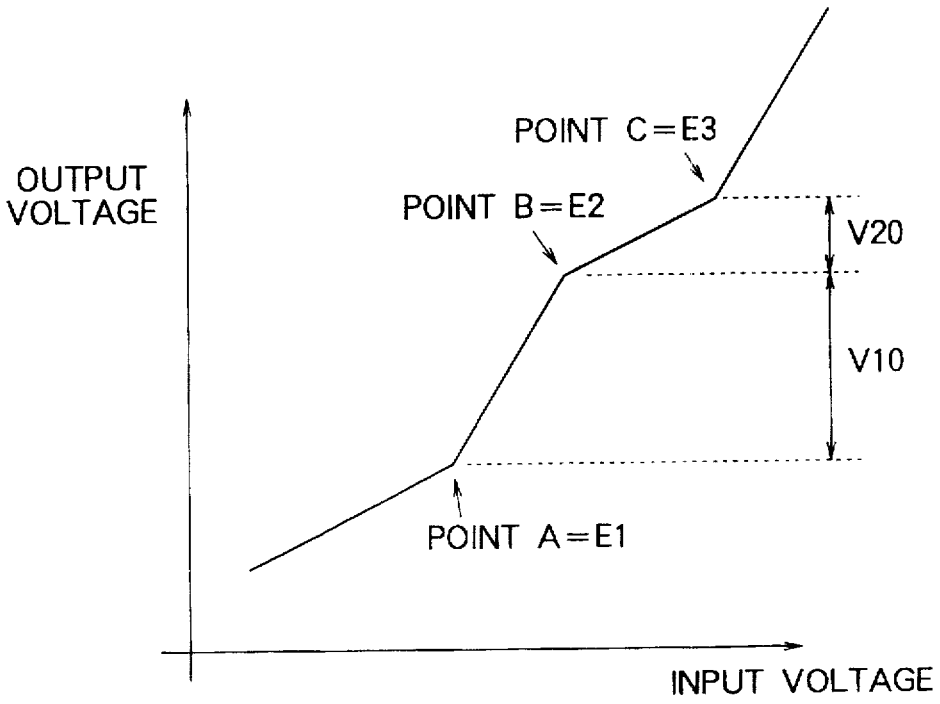
FIG. 1 is an illustration showing a gamma correction curve for explaining the first embodiment of the present invention.

As shown in FIG. 1, the gamma correction curve having three inflection points has the same gain (tilt) at the portion lower than the point A and the portion between the points B and C and moreover, the same gain (tilt) at the portion between the points A and B and the portion higher than the point C. Though these tilts are shown by straight lines in FIG. 1, the same is applied to curves. Moreover, the sum of the potential difference V10 between the points A and B and the potential difference V20 between the points B and C is set to the maximum value of an output-signal amplitude.

In the case of the input/output voltage characteristic of the gamma correction curve, luminance adjustment has been performed so far by fixing the gamma correction curve and a common voltage and changing an input voltage. In the case of the present invention, however, the input voltage is fixed and the gamma correction curve and the common voltage are simultaneously changed as shown by the input/output characteristic curve in FIG. 2. The common voltage changes by the same value as a voltage changing in the output voltage direction of the gamma correction curve and moreover, changes so that the black level $\epsilon$ of an input signal voltage always becomes equal to the output voltage V2.

Figure 2:
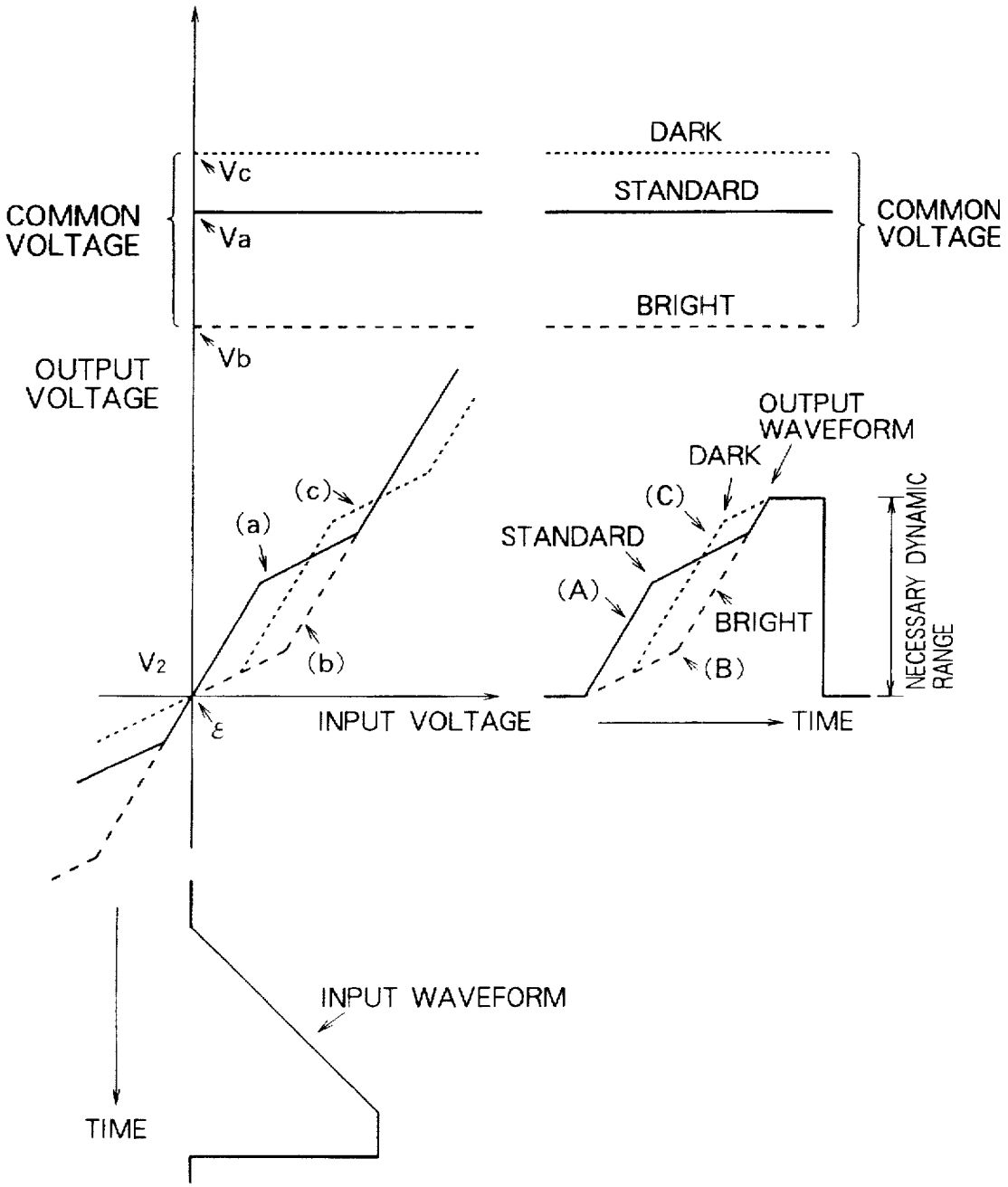
FIG. 2 is an illustration showing changes of an output waveform to movement of the gamma correction curve in the first embodiment of the present invention.

Output waveforms thus obtained by changing the gamma correction curve are shown by (A), (B), and (C) in FIG. 2. The output waveform comes to (A) when the gamma correction curve is (a) and the common voltage is $Va$, it comes to (B) when the gamma correction curve is (b) and the common voltage is $Vb$, and it comes to (C) when the gamma correction curve is (c) and the common voltage is $Vc$.

Figure 11:
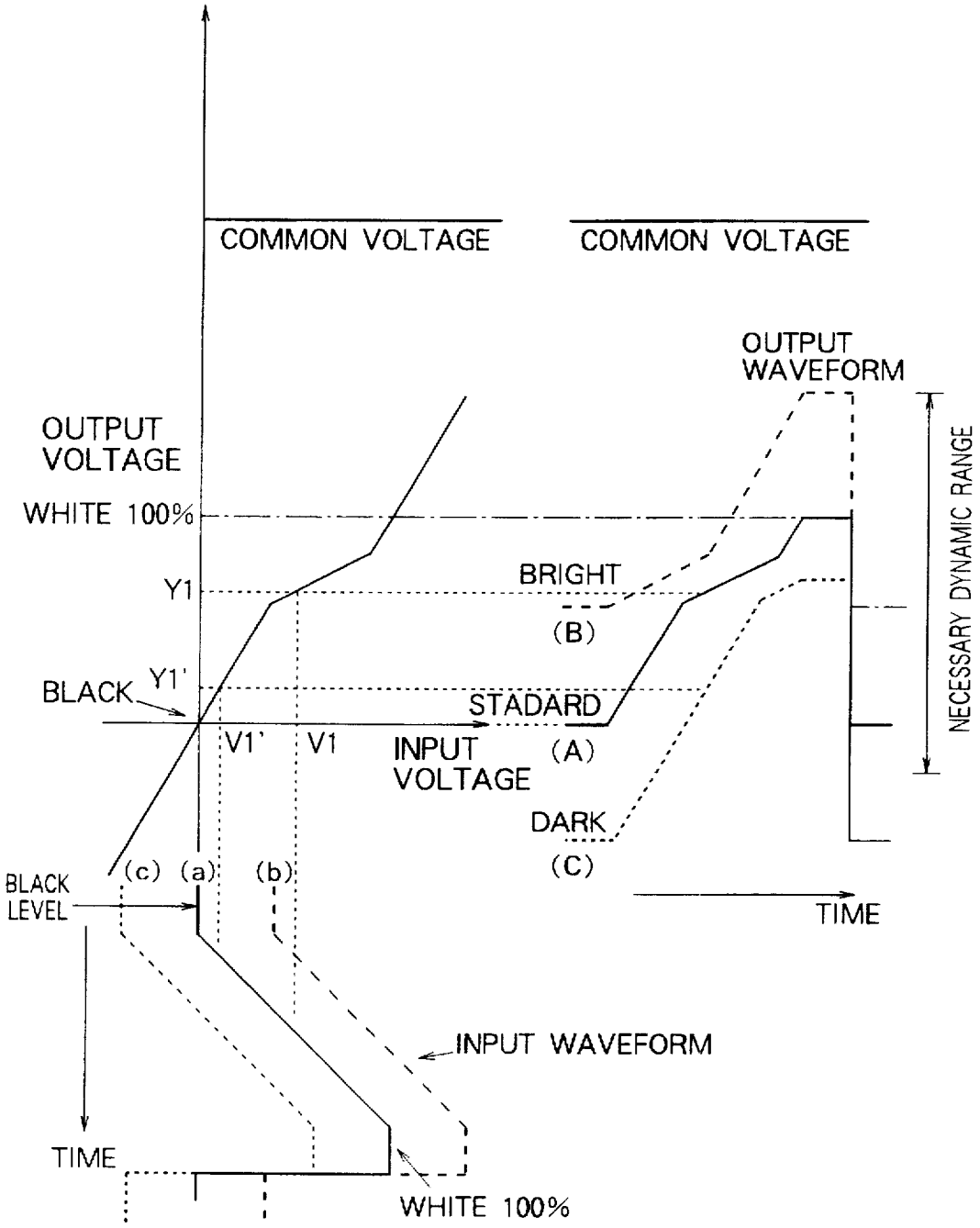
FIG. 11 is an illustration for explaining a conventional luminance adjusting apparatus.
Figure 12:
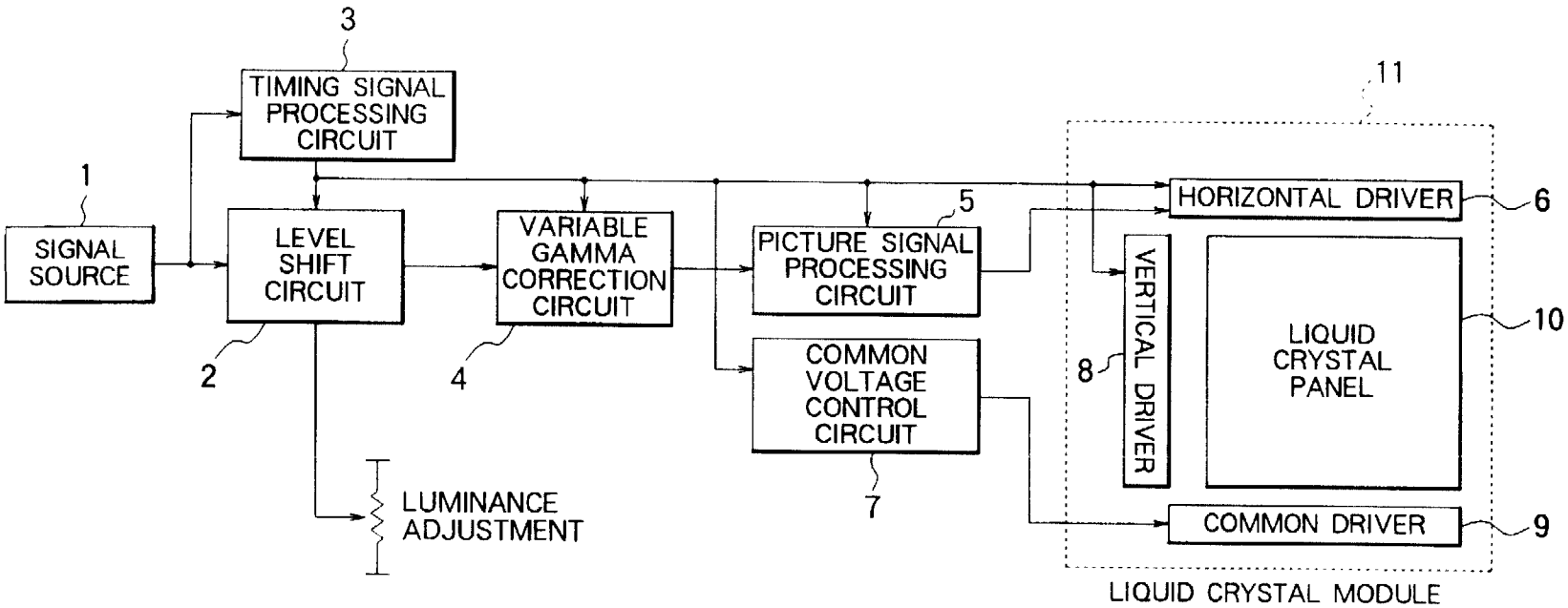
FIG. 12 is an illustration showing a conventional gamma correction circuit.
Figure 13:
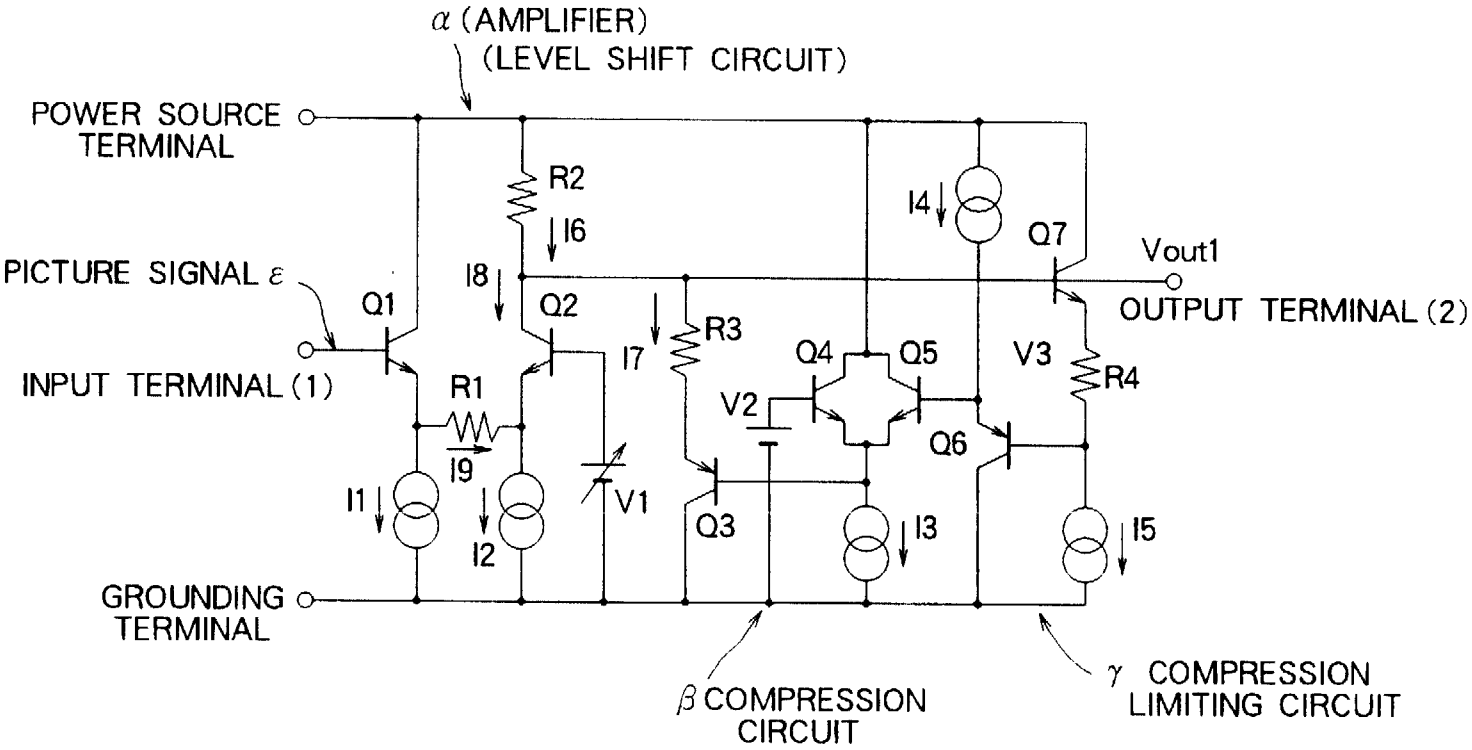
FIG. 13 is a circuit diagram showing a conventional correction circuit.
Figure 14:
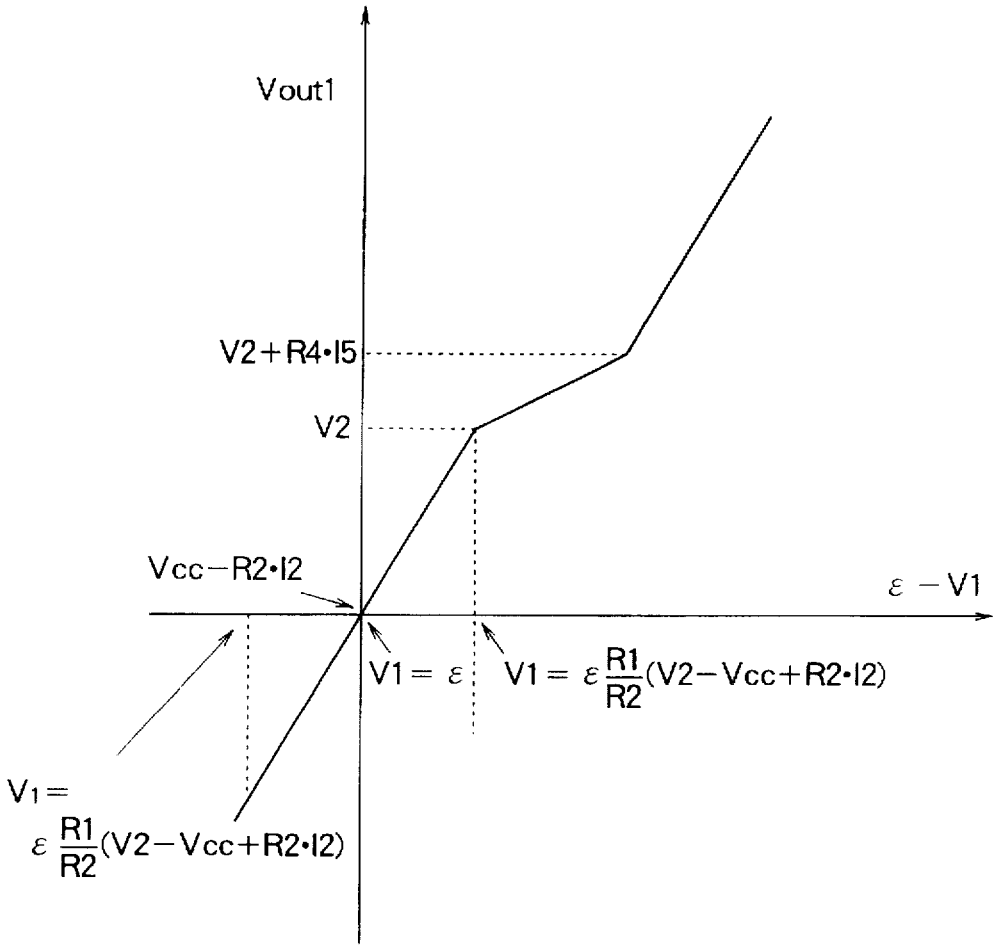
FIG. 14 is an illustration for explaining a conventional gamma correction circuit.

When comparing the conventional input/output characteristic in FIG. 11 with that of the present invention in FIG. 2, the waveform in FIG. 2A is the same as that in FIG. 11A. The curve (B) in FIG. 2 is the same as a curve obtained by translating the curve (B) and the common voltage in FIG. 11. That is, because the relation between output voltage of a gamma correction circuit and common voltage does not change, the curve shows the same luminance as the conventional curve. The curve (C) in FIG. 2 is also obtained by translating the curve (C) in FIG. 11. Therefore, it is clear that the curve shows a luminance equivalent to that in FIG. 11. When the curve C in FIG. 11 is simply translated, black-side gradations are lost. Therefore, the present invention secures gradations by setting one more infliction point which is not present on the conventional curve on a gamma correction curve and limiting a black-side gain. Inversely saying, the gamma correction curve is moved so that these output waveforms can be obtained.

By adjusting the gamma correction curve as described above, the output voltage range of the gamma correction circuit becomes narrower than that of a conventional one and therefore, it is possible to decrease the withstand voltage of the horizontal driver and thereby decrease the cost of the liquid crystal panel.

Figure 3:
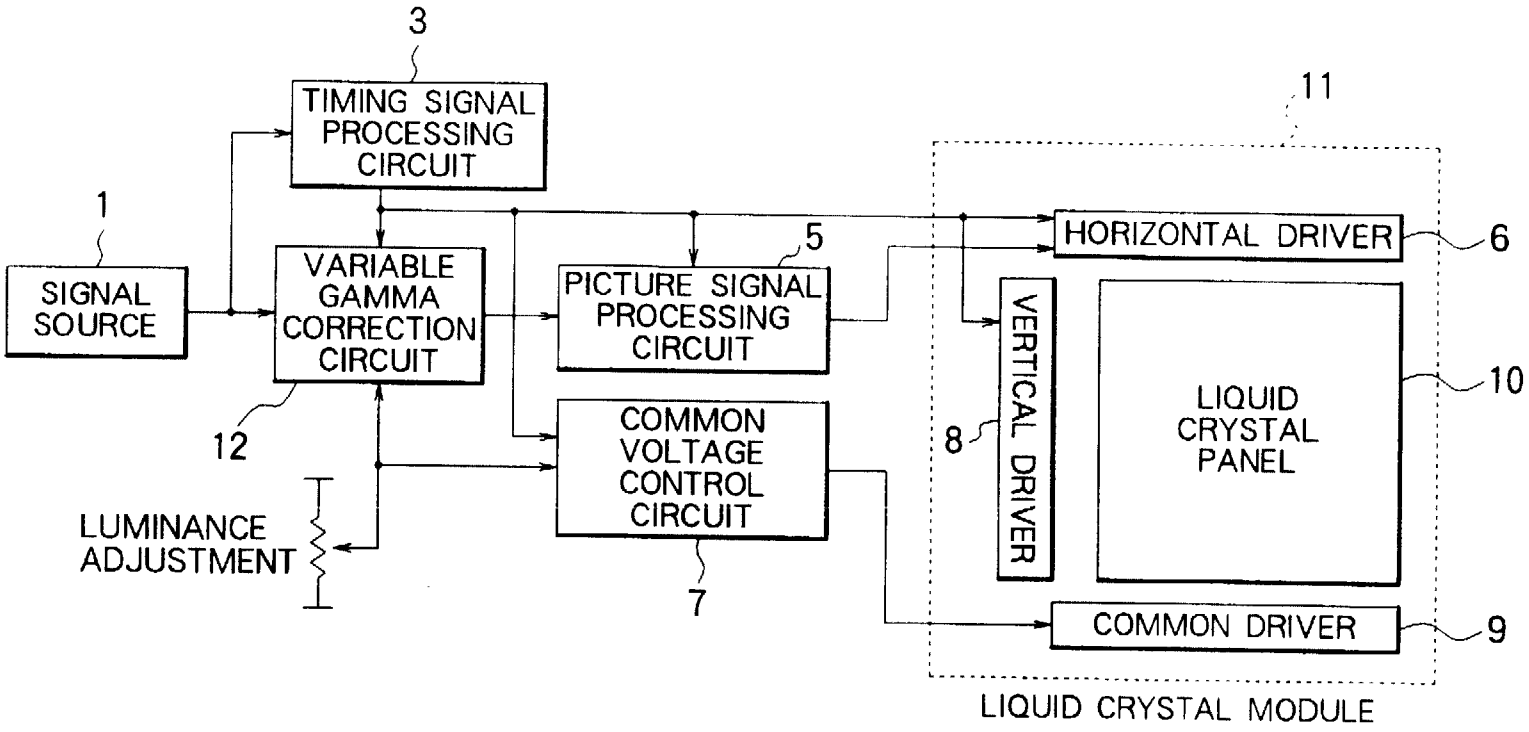
FIG. 3 is a block diagram showing the first embodiment of the luminance adjusting apparatus of the present invention.

A luminance adjusting apparatus for realizing the above luminance adjustment is described below by referring to FIG. 3.

The luminance adjusting apparatus comprises a variable gamma correction circuit 12 for synchronizing an infliction point of a gamma correction curve with a common voltage generated by the common voltage control circuit 7 by the fact that a luminance adjusting dial is adjusted and the timing signal processing circuit 3 for generating a timing pulse. The variable gamma correction circuit 12 and the timing signal processing circuit 3 connect with the picture signal processing circuit 5 for processing a picture signal, and the picture signal processing circuit 5 and the timing signal processing circuit 3 connect with the horizontal driver 6. The timing signal processing circuit 3 connects with the common voltage generation circuit 7 for generating a common voltage and a vertical driver 8 and the common voltage generation circuit 7 connects with a common driver 9.

Therefore, by inputting a picture signal to the variable gamma correction circuit 12 from the signal source 1 and manually adjusting the luminance adjusting dial, an infliction point on a gamma correction curve is synchronized with a common voltage generated by the common voltage control circuit 7.

Gamma correction and luminance adjustment are applied to the inputted picture signal in accordance with the characteristic of a liquid crystal panel and moreover, a positive-polarity picture signal with the same polarity as the corrected signal and a negative-polarity picture signal with the opposite polarity to the corrected signal are generated and applied to the liquid crystal panel 10 through the horizontal driver 6. Moreover, correspondingly to signal polarity inversion, the polarity of a common electrode voltage of the liquid crystal panel 10 is inverted and the voltage is applied to the liquid crystal panel 10 through the common driver 9. The timing signal processing section 3 extracts a sync signal from a picture signal, generates a timing pulse synchronous with the sync signal, and supplies the signal to the horizontal driver 6, vertical driver 8, and each signal processing section to synchronize the whole operation of the system.

It is possible to replace the signal source 1 with a circuit structure for processing an external signal, which comprises an antenna, a tunner, a video/chroma circuit, and a control circuit. The circuit structure other than the signal source and operations are the same as those of the above embodiment.

Then, the second embodiment of the luminance adjusting apparatus of the present invention is described below by referring to the accompanying drawings. A component same as that in FIG. 3 is provided with the same symbol and its description is omitted.

Figure 4:
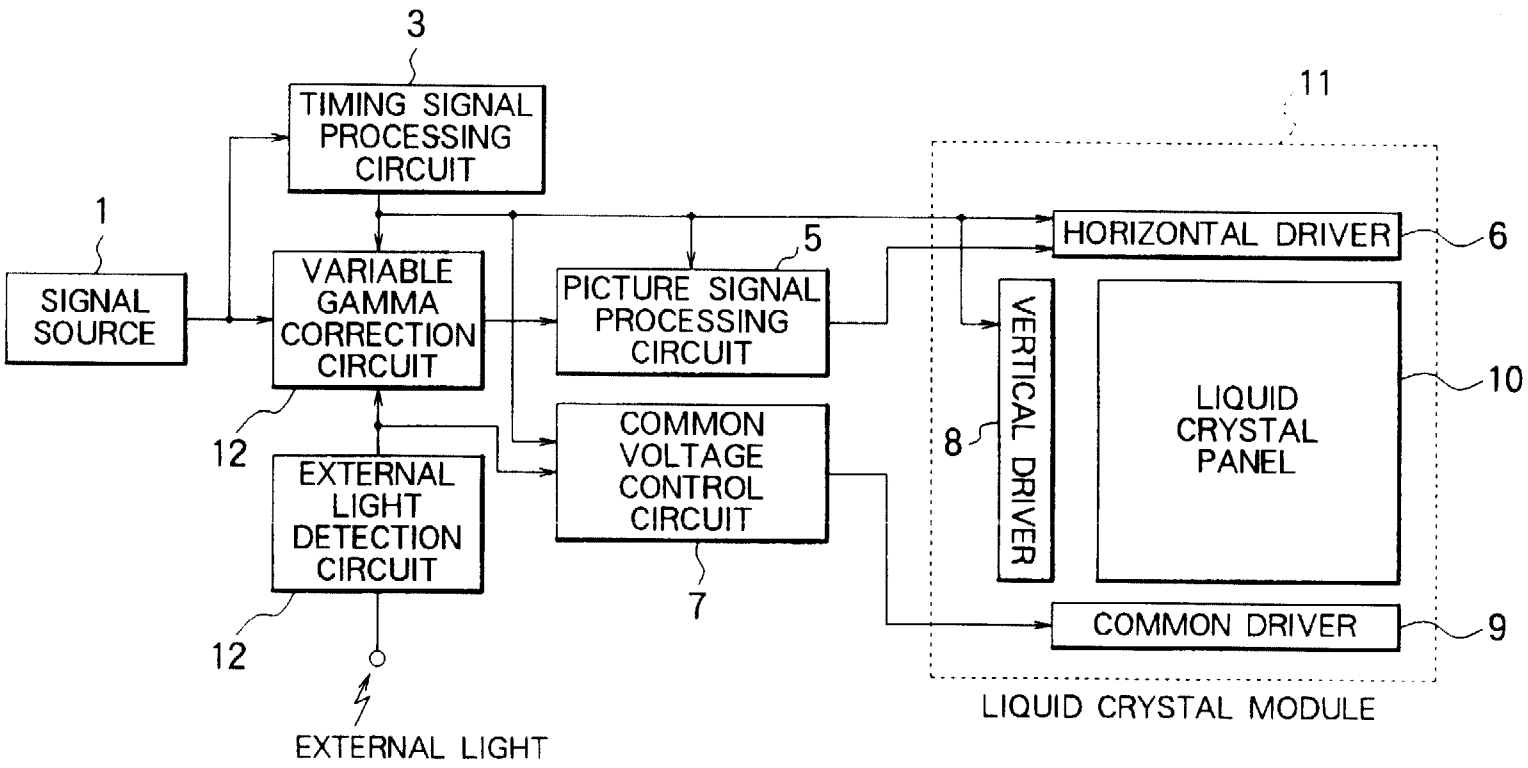
FIG. 4 is a block diagram showing the second embodiment of the luminance adjusting apparatus of the present invention.

The luminance adjusting apparatus of this embodiment is provided with an external light detection circuit 13 as shown in FIG. 4 and constituted so as to change infliction points of the variable gamma correction circuit 12 and common voltages. Therefore, the luminance adjustment manually performed in the case of the first embodiment shown in FIG. 3 is automatically performed in the case of this embodiment.

Then, the third embodiment of the luminance adjusting apparatus of the present invention is described below by referring to the accompanying drawings. A component same as that in FIG. 3 is provided with the same symbol and its description is omitted.

Figure 5:
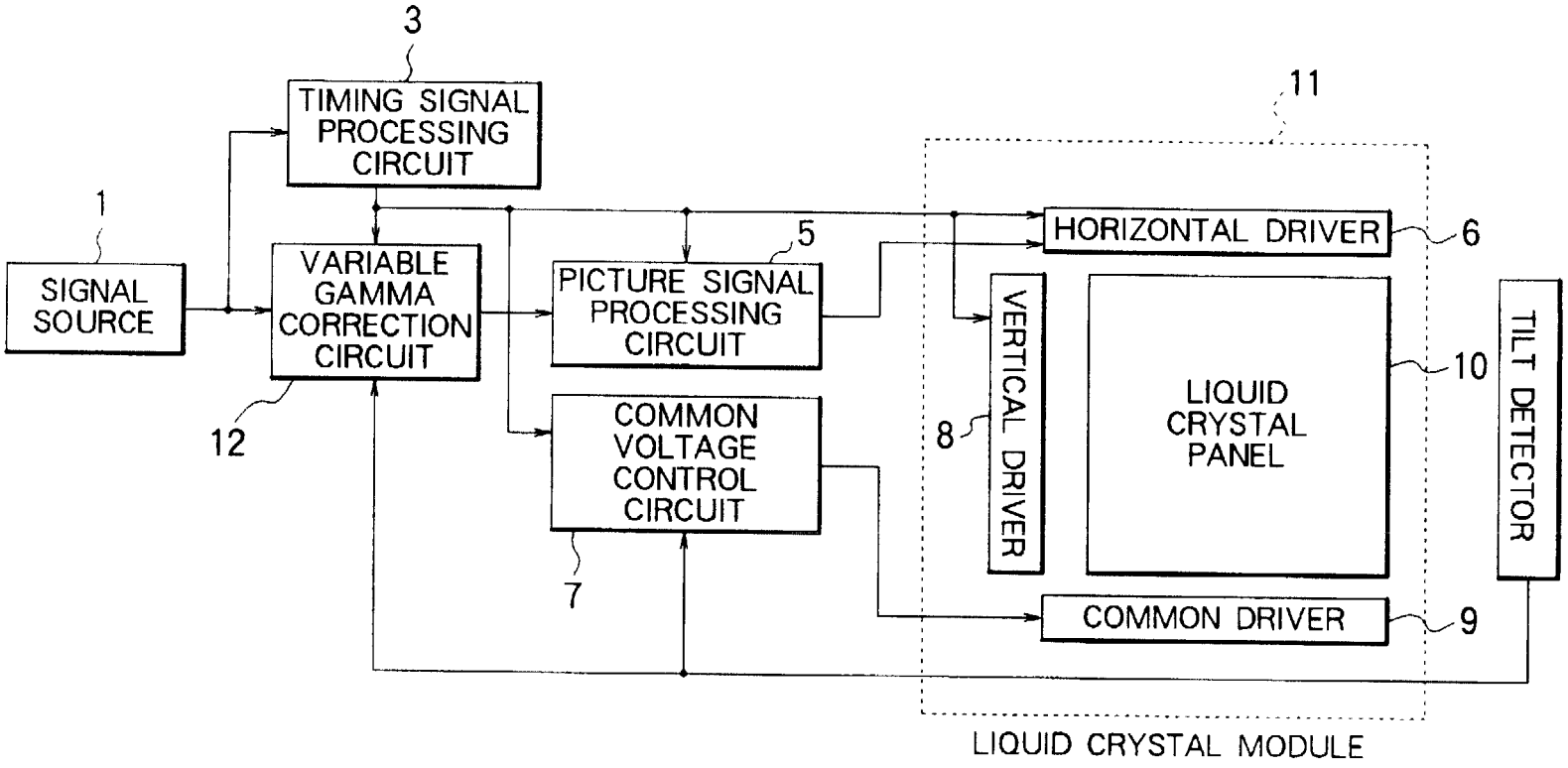
FIG. 5 is a block diagram showing the third embodiment of the luminance adjusting apparatus of the present invention.

The luminance adjusting apparatus of this embodiment is provided with a tilt detector 14 for detecting a tilt of the liquid crystal module 11 as shown in FIG. 5, in which infliction points of the variable gamma correction circuit 12 and common voltages are changed due to a tilt of the liquid crystal module 11 and luminance adjustment is automatically performed in accordance with the tilt of the liquid crystal module.

Figure 6:
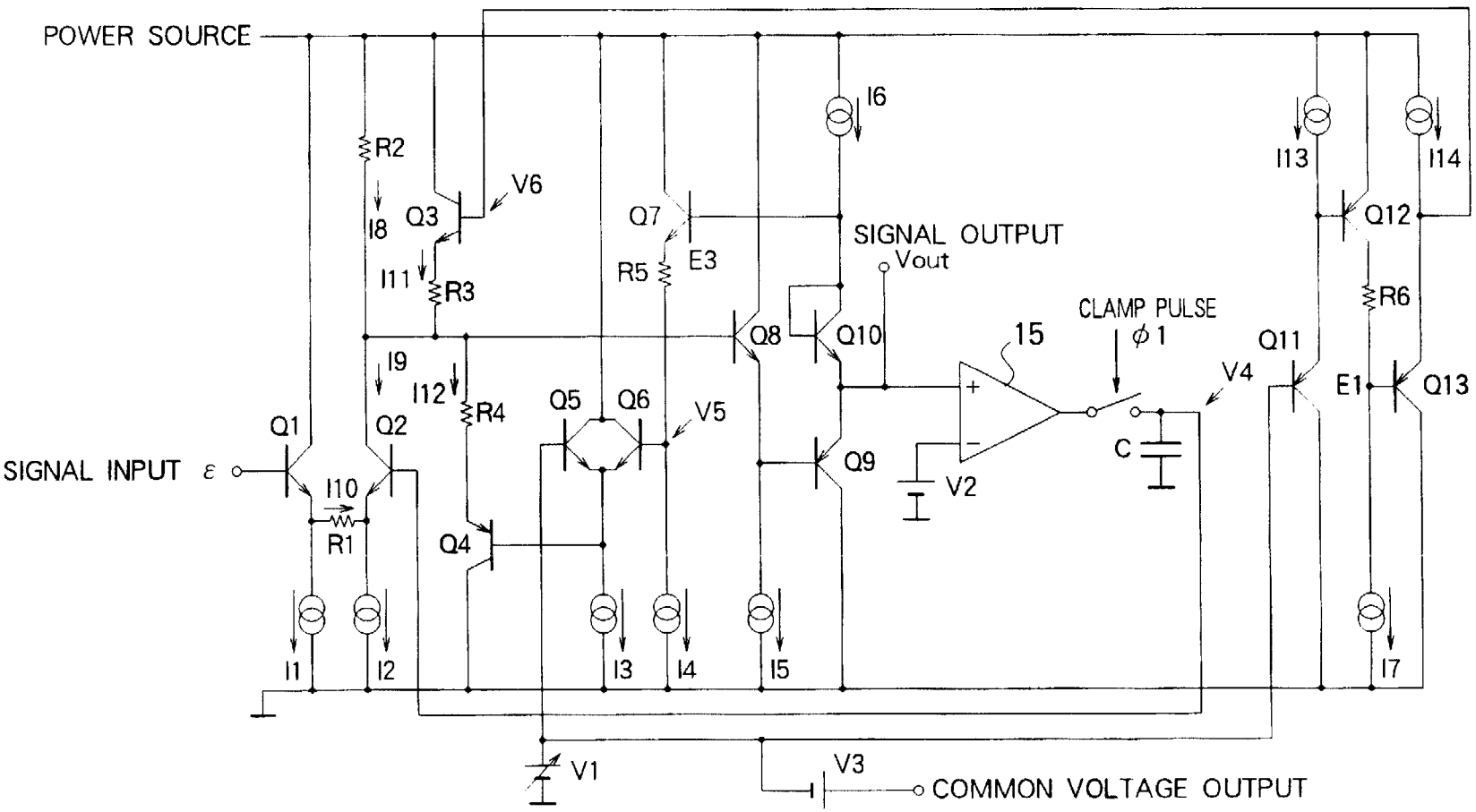
FIG. 6 is a circuit diagram showing a variable gamma correction circuit of the luminance adjusting apparatus of the present invention.

The variable gamma correction circuit 12 is described below by referring to FIG. 6.

An amplifier comprises transistors Q1 and Q2, constant current sources I1 and I2, and resistances R1 and R2. An input signal ϵ is supplied to the base of Q1 and an output voltage of a differential amplifier 15 for clamping a black level is supplied to the base of Q2 so that a black level of an output signal of the above amplifier becomes V2 (constant). The output terminal of the amplifier connects with a first compression circuit serving as first compression means comprising transistors Q4 and Q7, a constant current source I3, a variable power source V1, and a resistance R4 and a second compression circuit serving as second compression means comprising transistors Q3, Q11, Q12, and Q13, constant current sources I7, I13, and I14, and resistances R3 and R6. Moreover, the output terminal connects with a compression limitation circuit serving as control means for limiting a compression ratio of a second compression circuit comprising transistors Q6, Q7, Q8, Q9, and Q10, constant current sources I4, I5, and I6, and a resistance R5.

Similarly to the case of a conventional embodiment, it is assumed that a base current of a transistor is ignored, a base-emitter voltage is VBE (constant) for an NPN or PNP transistor, a current flowing through R2 is I8, a current flowing through R3 is I11, a current flowing through R4 is I12, a collector current of the transistor Q2 is I9, and a current flowing though R1 is I10.

First, the base current V5 of Q6 is obtained as shown below.

$$\begin{aligned} V5 &= VOUT - VBE(Q8) + VBE(Q9) + VBE(Q10) - \\ &\quad VBE(Q7) - R5 \times I4 \\ &= VOUT - R5 \times I4 \end{aligned}$$

When noticing Q5 and Q6, emitters of Q5 and Q6 have a common potential. Therefore, when comparing the base potential V1 of Q5 with the base potential V5 of Q6, the emitter potential of Q5 comes to V1−VBE(Q5) because the constant current source I3 is applied to Q5 in the case of V1>V5. Similarly, the emitter potential of Q6 comes to V5−VBE(Q6) because the constant current source I3 is applied to Q6 in the case of V1<V5.

(I) Considering a Case of V1>V5

That is, the operation is performed in the case of V1>VOUT−R5×I4, that is, in the case of VOUT<V1+R5×I4 which is a transformation of the above inequality.

When noticing R4 and Q4, no current flows through Q4 or R4 (I12=0) unless VOUT is equal to or larger than V1−VBE(Q5)+VBE(Q4)=V1 because the base potential of Q4 (emitter potential of Q5) is V1−VBE(Q5) as described above.

When VOUT is V1 or higher, a current of I12=(VOUT−V1)/R4 flows through Q4 or R4.

Moreover, when noticing R3 and Q3, the base potential V6 of Q3 is obtained from the following equation.

$$\begin{aligned} V6 &= V1 + VBE(Q11) - VBE(Q12) - R6 \times 17 + VBE(Q13) \\ &= V1 - R6 \times I7 + VBE(Q13) \end{aligned}$$

Therefore, no current flows through Q3 or R3 (I11=0) unless VOUT comes to V6−VBE(Q3) or less. Therefore, when the following inequality is effected, the following current I11 shown by the following equation flows through Q3 and R3.

$$\begin{aligned} VOUT < V6 - VBE(Q3) &= V1 - R6 \times I7 + VBE(Q13) - \\ &\quad VBE(Q3) \\ &= V1 - R6 \times I7 \end{aligned}$$

$$\begin{aligned} I11 &= (V6 - VBE(Q3) - VOUT)/R3 \\ &= (V1 - R6 \times I7 - VOUT)/R3 \end{aligned}$$

Therefore, by setting the following equations, three conditions (a), (b), and (c) below are effected.

V1+R5×I4=E3

V1=E2

V1−R6×I7=E7

(a) E3>VOUT>E2, (b) E2>VOUT>E1, and (c) VOUT<E1

(a) In the case of E3>VOUT>E2, the following equations are effected.

I11=0

I8=I9+I12

I9+I10=I2

I10=(ϵ−V4)/R1

I12=(VOUT−V1)/R4

VOUT=VCC−R2×I8

By solving the above simultaneous equation, the following expression is obtained.

$$VOUT = \frac{R4}{R4+R2} \times \left( VCC - R2 \times I2 - \frac{R2}{R1} \times V4 + \frac{R2}{R4} \times V1 \right) + \frac{R4}{R4+R2} \times \frac{R2}{R1} \times \epsilon \quad (1)$$

(b) In the case of E2>VOUT>E1, the following equations are effected.

I11=I12=0

I8+I10=I2

I10=(ϵ−V4)/R1

VOUT=VCC−R2×I8

By solving the above simultaneous equation, the following expression is obtained.

$$VOUT=VCC-R2\times I2-R2/R1\times V4+R2/R1\times\epsilon \quad (2)$$

(c) In the case of VOUT<E1, the following equations are effected.

I12=0

I8+I11=I9

I9+I10=I2

I10=(ϵ−V4)/R1

I11=(V1−R6×I7−VOUT)/R3

VOUT=VCC−R2×I8

By solving the above simultaneous equation, the following expression is obtained.

$$VOUT = \frac{R3}{R2+R3} \times \left\{ VCC - R2 \times I2 - \frac{R2}{R1} \times V4 + \frac{R2}{R3} \times (V1 - R6 \times I7) \right\} + \frac{R3}{R2+R3} \times \frac{R2}{R1} \times \epsilon \quad (3)$$

That is, it is found that the gain of the area (a) in which the first compression circuit operates is compressed R4/(R4+R2) times compared to the gain R2/R1 of the area (b) in which neither first nor second compression circuits operate. Moreover, the area (c) in which the second compression circuit operates is compressed R3/(R2+R3) times.

(II) Considering a Case of V1<V5

Namely, this is a case of V1<VOUT−R5×I4 or a case of VOUT>V1+R5×I4 which is a transformation of the above inequality.

In this case, the following equations are effected.

I11=0

I8=I9+I12

I9+I10=I2

I10=(ϵ−V4)/R1

I12=(VOUT−V5)/R4

VOUT=VCC−R2×I8

V5=VOUT−R5×I4

By solving the above simultaneous equation, the following expression is obtained.

$$VOUT1 = VCC - R2 \times I2 - \frac{R2}{R1} \times V4 - \frac{R2}{R4} \times R5 \times I4 + \frac{R2}{R1} \times \epsilon \quad (4)$$

That is, in this area, the gain compressed by the first compression circuit is equal to the gain where compression is limited and no compression circuit operates.

In accordance with the above calculation results, it is possible to change the gamma correction curve shown in FIG. 2 depending on how to set V1 (variable) to V2 (invariable). For example, by setting V1 so as to meet the inequality V1−R6×I7<V2<V1 and setting VOUT=V2 when $\epsilon=\epsilon_0$ ($\epsilon_0$ represents a black level of an input signal) in the expression (2), the following expressions are obtained.

$$VCC - R2 \times I2 - R2/R1 \times V4 + R2/R1 \times \epsilon_0 = V2$$

$$V4 = \epsilon_0 - (V2 - VCC + R2 \times I2) \times R1/R2 \quad (5)$$

That is, in this area, V4 shown by the expression (5) is outputted from the differential amplifier 15.

Figure 7A:
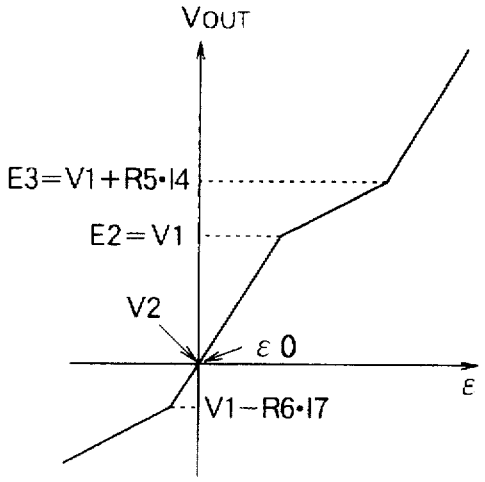
FIGS. 7A to 7C are illustrations for explaining the gamma correction curve of the present invention.
Figure 7B:
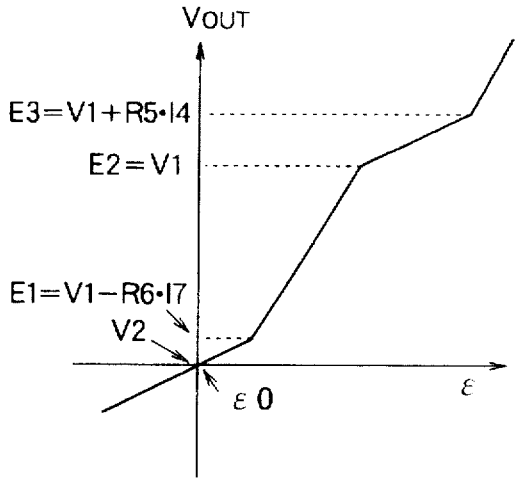
Figure 7C:
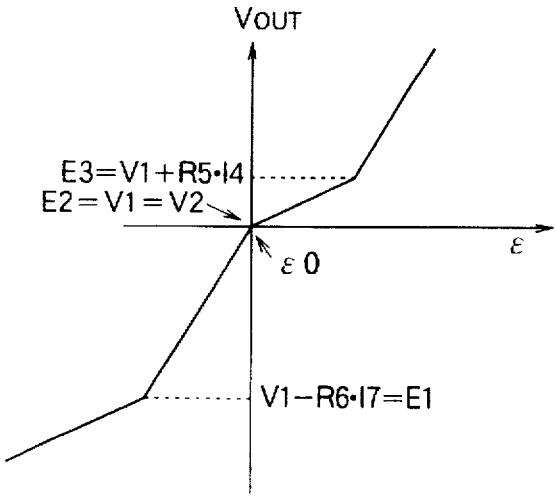
Figure 8:
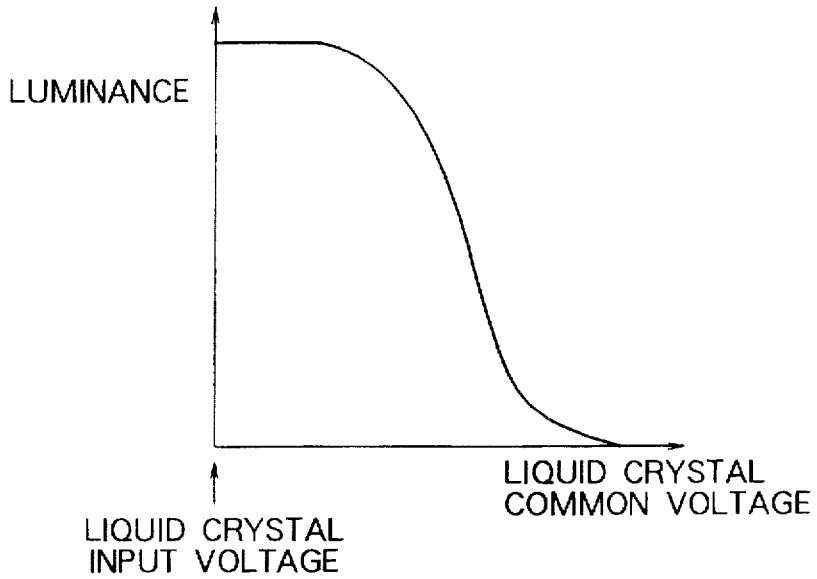
FIG. 8 is an illustration showing a luminance characteristic curve for an input signal of normally-white liquid crystal.
Figure 9:
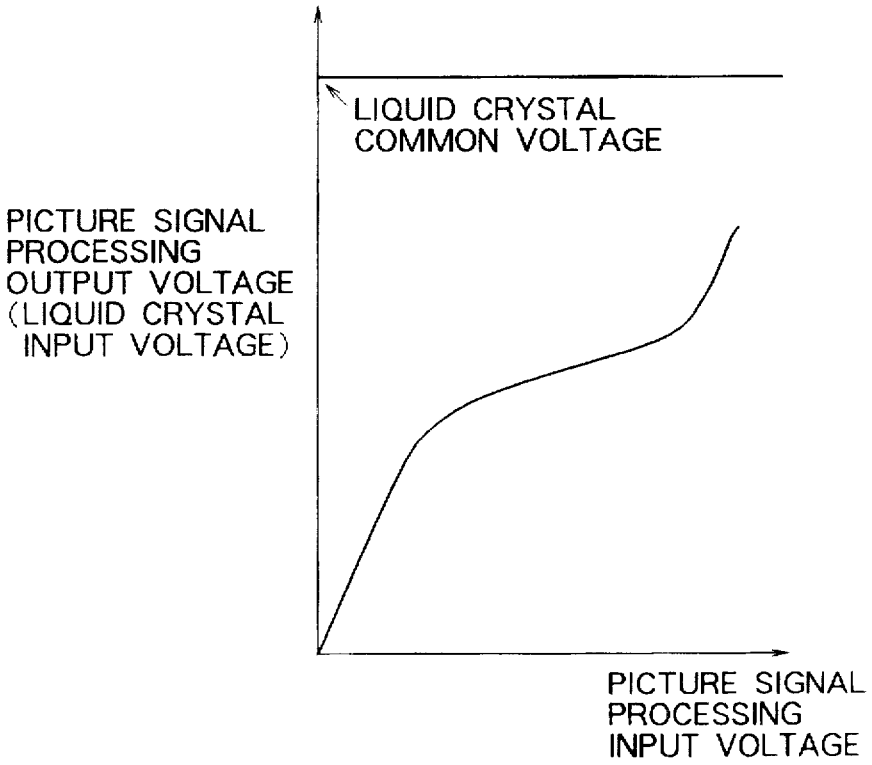
FIG. 9 is an illustration showing a gamma correction curve of normally-white liquid crystal.
Figure 10:
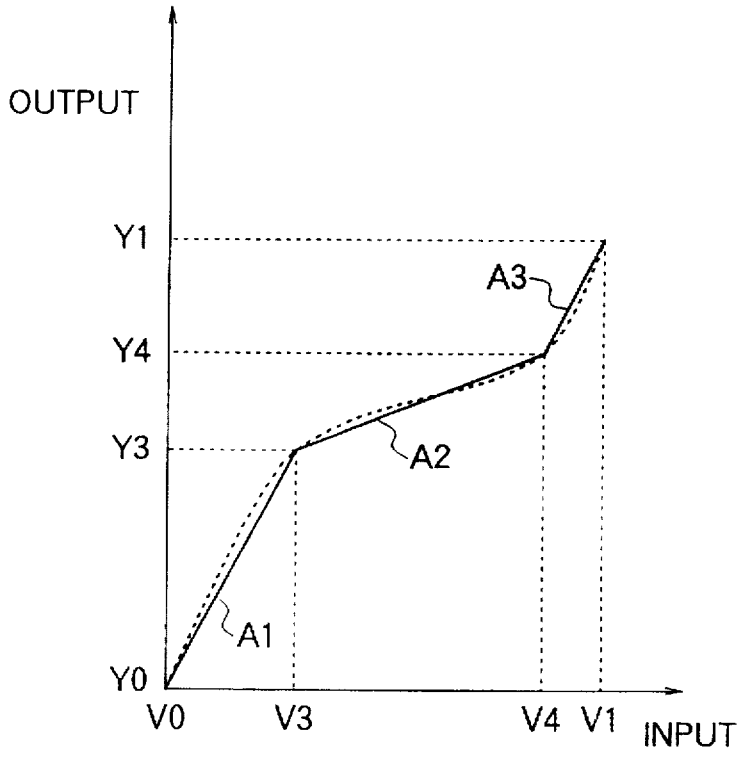
FIG. 10 is an illustration showing a conventional gamma correction curve.

By substituting V4 for the expression (4) from the expression (1), expressions of straight lines are shown. FIG. 7(*a*) shows these expressions as graphs. Also when setting V1 to other conditions, results are obtained as shown in FIGS. 7(*b*) and 7(*c*) in the same manner.

However, because a common voltage is set to V1+V3, it is needless to say that the common voltage linearly changes to the change of V1.

Many widely different embodiments of the present invention may be constructed without departing from the spirit and scope of the present invention. It should be understood that the present invention is not limited to the specific embodiments described in the specification, except as defined in the appended claims.

What is claimed is:

1. A luminance adjusting apparatus for adjusting a luminance of a liquid crystal display, comprising:

correction means for correcting an output voltage of a picture signal by changing three or more inflection points of a gamma correction curve;

voltage control means for controlling common electrode voltage; and adjustment means for adjusting said voltage control means synchronously with said correction means.

2. The luminance adjusting apparatus according to claim 1, wherein said adjustment means is manually adjustable.

3. The luminance adjusting apparatus according to claim 1, wherein said adjustment means detects a light intensity around said liquid crystal display and synchronously changes said correction means and said voltage control means in accordance with the detected intensity.

4. The luminance adjusting apparatus according to claim 1, wherein said adjustment means detects a tilt of the screen of said liquid crystal display and synchronously changes said correction means and said voltage control means in accordance with the detected tilt.

5. The luminance adjusting apparatus according to claim 1, wherein the luminance adjusting apparatus further comprises a pedestal clamp circuit for clamping a pedestal level of an output signal at a first predetermined voltage.

6. The luminance adjusting apparatus according to claim 1, wherein said adjustment means changes said common electrode voltage so that the voltage equals the sum of the voltage of one of said inflection points and a predetermined voltage.

7. A luminance adjusting apparatus for adjusting a luminance of a liquid crystal display, comprising:

means for setting a first reference voltage, a second reference voltage higher than said first reference voltage, and a third reference voltage higher than said second reference voltage as inflection points of a gamma correction curve;

means for compressing an output voltage of a picture signal when the voltage is lower than said first reference voltage at a first compression ratio;

means for compressing said output voltage when the voltage is higher than said second reference voltage at a second compression ratio;

means for limiting said second compression ratio when said output voltage is higher than said third reference voltage;

correction means for correcting said output voltage by synchronously changing said first and second reference voltages; and adjustment means for adjusting a common electrode voltage synchronously with said correction means.

8. The luminance adjusting apparatus according to claim 7, wherein the luminance adjusting apparatus further comprises a pedestal clamp circuit for clamping a pedestal level of an output signal at a first predetermined voltage.

9. The luminance adjusting apparatus according to claim 7, wherein the luminance adjusting apparatus further comprises means for changing said second reference voltage.

10. The luminance adjusting apparatus according to claim 7, wherein said correction means synchronously changes said first and second reference voltages so that the difference between said first reference voltage and said second reference voltage becomes equal to or larger than the difference between said second reference voltage and said third reference voltage.

11. The luminance adjusting apparatus according to claim 7, wherein said adjustment means changes said common electrode voltage so as to be equal to the sum of said second reference voltage and a predetermined voltage.

* * * * *